US005852844A

United States Patent [19]

Leifeld

[11] Patent Number: 5,852,844

[45] Date of Patent: Dec. 29, 1998

[54] SUCTION APPARATUS FOR REMOVING WASTE FROM A DRAWING FRAME INLET

[75] Inventor: Ferdinand Leifeld, Kempen, Germany

[73] Assignee: Trützschler GmbH & Co. KG, Mönchengladbach, Germany

[21] Appl. No.: 648,985

[22] Filed: May 17, 1996

[30] Foreign Application Priority Data

May 18, 1995 [DE] Germany ..... 195 18 302.9

[51] Int. Cl.[6] ..... D01H 5/62

[52] U.S. Cl. ..... 15/301; 19/159 A

[58] Field of Search ..... 15/301; 19/236, 19/237, 238, 67.5, 159 A

[56] References Cited

U.S. PATENT DOCUMENTS

| | | | |
|---|---|---|---|
| 2,719,335 | 10/1955 | Buchanan et al. | 15/301 X |
| 4,306,337 | 12/1981 | Sutter | 57/305 X |
| 4,642,852 | 2/1987 | Turner et al. | 19/236 |
| 5,157,910 | 10/1992 | Artzt et al. | 57/308 |
| 5,321,942 | 6/1994 | Hartness | 57/301 |
| 5,398,382 | 3/1995 | Leifeld | 15/312.1 X |
| 5,575,143 | 11/1996 | Gengler | 57/301 X |

FOREIGN PATENT DOCUMENTS

| | | | |
|---|---|---|---|
| 936 252 | 12/1955 | Germany . | |
| 1 104 403 | 4/1961 | Germany . | |
| 29 07 747 | 9/1979 | Germany . | |
| 1064694 | 4/1967 | United Kingdom | 15/301 |

*Primary Examiner*—Chris K. Moore
*Attorney, Agent, or Firm*—Venable; Gabor J. Kelemen

[57] ABSTRACT

A combination of a sliver intake assembly for guiding and introducing simultaneously a plurality of slivers into a drawing frame and a suction assembly for removing waste, such as dust or fiber fly. The combination includes an emplacement situated below the sliver intake assembly for accommodating a plurality of coiler cans from which slivers are withdrawn by the sliver intake assembly. The suction assembly has a suction duct which extends along the sliver intake assembly in a region thereof for drawing waste thereinto by vacuum.

18 Claims, 5 Drawing Sheets

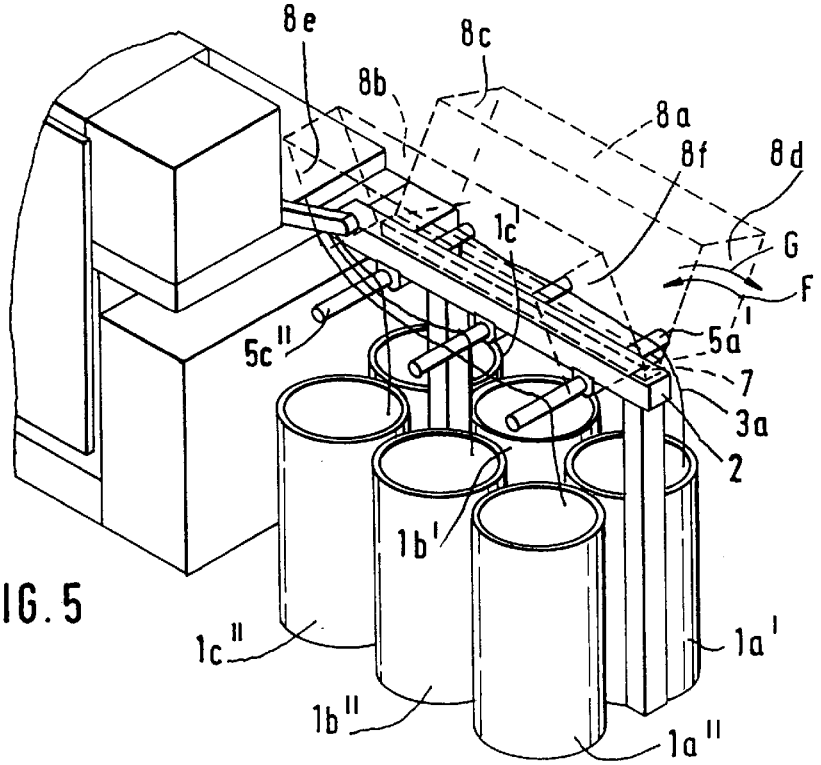
FIG. 5
FIG. 6
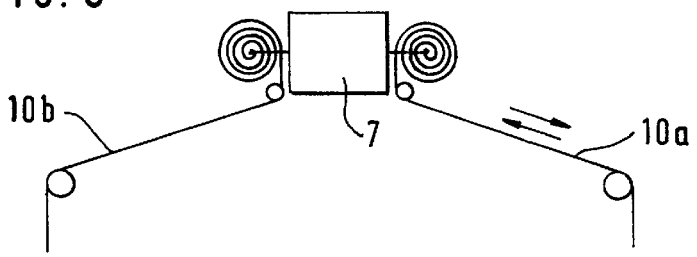
FIG. 7
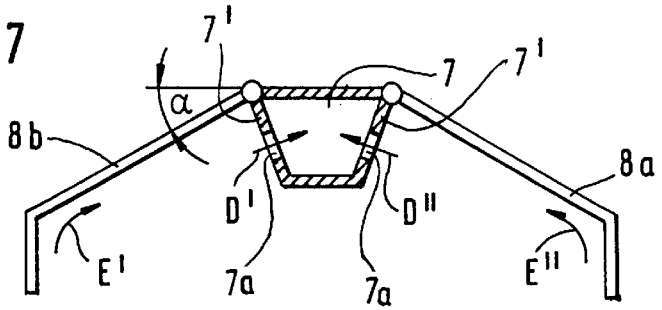

SUCTION APPARATUS FOR REMOVING WASTE FROM A DRAWING FRAME INLET

CROSS REFERENCE TO RELATED APPLICATION

This application claims the priority of German Application No. 195 18 302.9 filed May 18, 1995, which is incorporated herein by reference.

BACKGROUND OF THE INVENTION

This invention relates to an apparatus for removing dust, fiber fly or the like by vacuum from the region of a sliver intake assembly which is situated at the input side of a drawing frame and which includes sliver guiding elements for the slivers withdrawn from coiler cans situated at the sliver intake assembly. The apparatus has air guiding means and a suction device for withdrawing the waste.

German Offenlegungsschrift (application published without examination) No. 29 07 747 discloses an apparatus arranged at a feed table of a drawing frame for pneumatic cleaning. The feed table has a plurality of intake locations, each associated with a roll pair defining a clamping gap (nip) for withdrawing sliver from a respective sliver storing device such as a coiler can and further, with each roll pair sliver guiding elements are associated. At least the sliver guiding elements are associated with an air guiding device connected with a vacuum source. Stated differently, an individual suction arrangement is provided for each sliver guiding device associated with the respective roll pairs. It is a disadvantage of this conventional arrangement that dust, fiber fly and the like present externally of the roll pairs and the sliver guiding elements cannot be trapped and drawn away. The flow conditions are only locally defined. Further, the provision of a plurality of individual suction devices involves a substantial technical and constructional outlay.

SUMMARY OF THE INVENTION

It is an object of the invention to provide an improved apparatus of the above-outlined type from which the discussed disadvantages are eliminated and which, in particular, makes possible an improved removal by suction of dust, fiber fly and the like at the sliver intake assembly of the drawing frame in a structurally simple manner.

This object and others to become apparent as the specification progresses, are accomplished by the invention, according to which, briefly stated, a combination of a sliver intake assembly for guiding and introducing simultaneously a plurality of slivers into a drawing frame and a suction assembly for removing waste includes an emplacement situated below the sliver intake assembly for accommodating a plurality of coiler cans from which slivers are withdrawn by the sliver intake assembly. The suction assembly has a suction duct which extends along the sliver intake assembly in a region thereof for drawing waste thereinto by vacuum.

By virtue of the fact that according to the invention a single suction device with a throughgoing air flow is provided for the several sliver intake locations of the sliver intake assembly forming part of a drawing frame, a plurality of individual suction devices and thus a plurality of air guiding elements associated therewith leading to the plurality of suction devices are avoided, whereby the apparatus is structurally significantly simplified. A single, common suction assembly makes possible a suction removal from the spatial environment of the sliver intake assembly of the drawing frame, as a result of which dust, fiber fly and the like is drawn away by suction even externally of the roll pairs and the sliver guiding elements, for example, from the region of the coiler can tops as the sliver is drawn out therefrom.

BRIEF DESCRIPTION OF THE DRAWINGS

FIG. 5 is a perspective view of another preferred embodiment of the invention.

FIG. 6 is a schematic end elevational view of yet another preferred embodiment of the invention.

FIG. 7 is schematic end elevational view, partially in section, of a variant shown in FIG. 2.

DESCRIPTION OF THE PREFERRED EMBODIMENTS

Figure 1A:
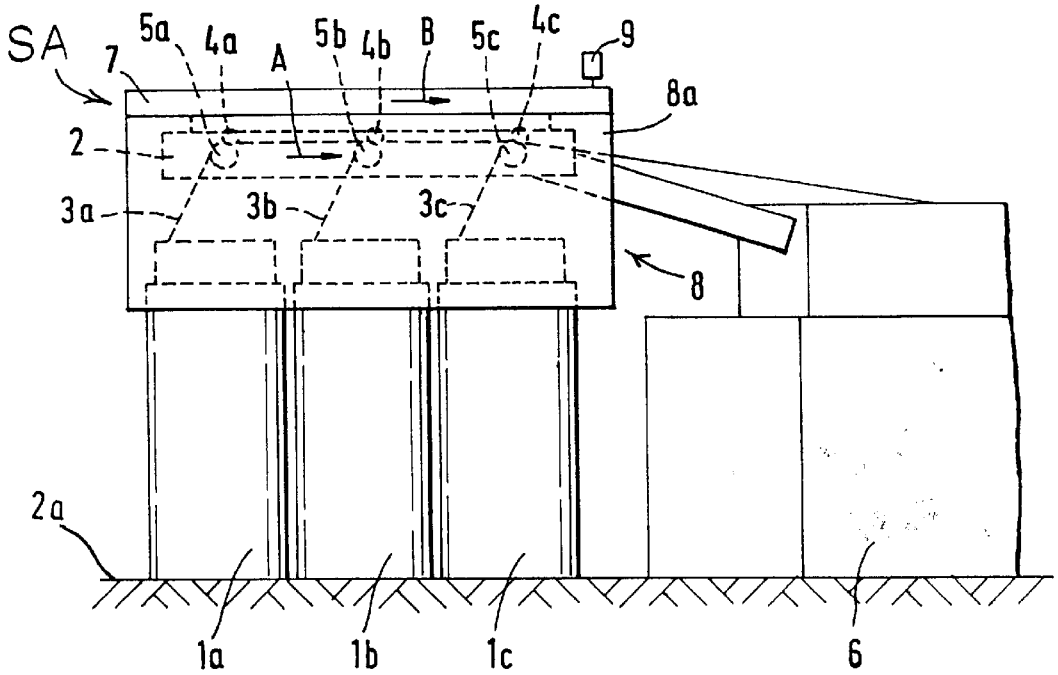
FIG. 1*a* is a schematic side elevational view of a preferred embodiment of the invention.
Figure 4:
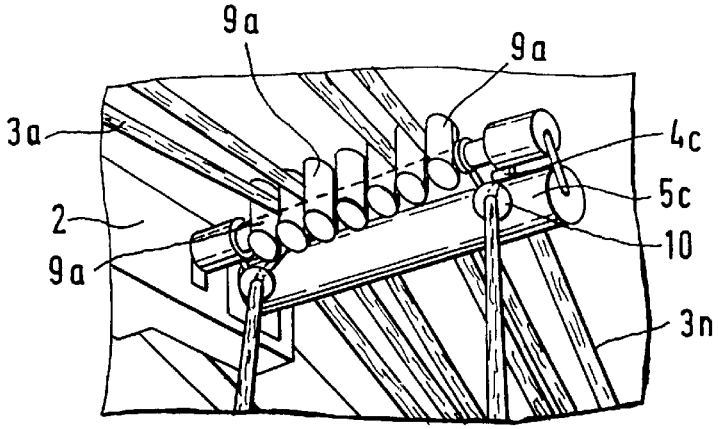
FIG. 4 is a perspective view of a detail of the construction shown in FIG. 1*a*.

Turning to FIG. 1*a*, a plurality of circular coiler cans 1*a*, 1*b* and 1*c* are situated on an emplacement 2*a* underneath an intake table 2 of a sliver intake assembly for simultaneously supplying a plurality of slivers 3*a*, 3*b* and 3*c* to a drawing frame 6 which may be, for example, a model HS machine, manufactured by Trützschler GmbH & Co. KG, M önchengladbach, Germany. The intake table 2 of the sliver intake assembly extends over the coiler cans 1*a*, 1*b* and 1*c* and carries a separate roll pair 4*a*, 5*a*; 4*b*, 5*b* and 4*c*, 5*c* for each respective coiler can 1*a*, 1*b* and 1*c*. The sliver extending from the coiler cans passes through the respective roll pair and is introduced therefrom, generally in a side-by-side relationship, into the drawing frame 6 for stretching and combining. At the output end of the drawing frame 6 the outputted sliver is, in a manner not shown, deposited in coils into a coiler can by a rotary coiler head. In the region of each lower roll 5*a*, 5*b* and 5*c* of the respective roll pair, guide elements 9*a* having upwardly open guide grooves are arranged for guiding the slivers 3*a*14 3*c* as illustrated in FIG. 4. There are further provided annular guide elements 10 through which the sliver passes as it rises from the coiler can underneath, immediately before being introduced into the respective roll pair.

Figure 1B:
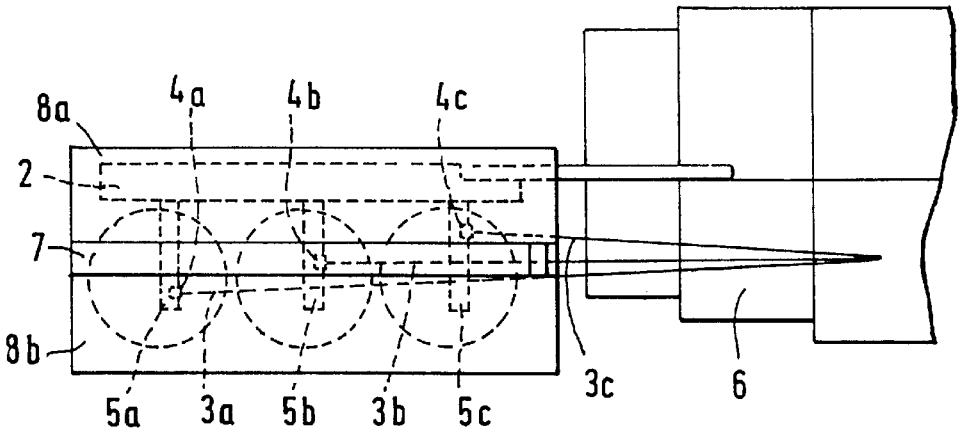
FIG. 1*b* is top plan view of the construction shown in FIG. 1*a*.

A suction assembly generally designated at SA which extends over the sliver intake assembly has a duct 7 coupled to a vacuum source 9 for the suction removal of dust, fiber fly and the like as well as a hood generally designated at 8, having lateral hood elements 8*a* and 8*b* which may have transparent portions for visually observing the inner space defined by the hood 8. The duct 7 extends parallel to the intake table 2 and above the coiler cans 1*a*–1*c*, and the hood elements 8*a*, 8*b* cover the sliver intake device, the coiler cans 1*a*–1*c*, the roll pairs 4*a*, 5*a*, 4*b*, 5*b* and 4*c*, 5*c* as well as the slivers 3*a*, 3*b* and 3*c* from above and from the side. The arrow A designates the advancing direction of the slivers 3*a*–3*c* at the level of the intake table 2, whereas the arrow B which is parallel to arrow A, designates the flow direction of the vacuum-generated air stream in the hood 7. The hood elements 8*a* and 8*b*, as shown in FIG. 1, are hinged to the duct 7 for pivotal motion in a vertical plane and are illustrated in their downwardly pivoted closed position in FIG. 1 to thus form an air guiding arrangement. Also, the duct 7, in its closed position, prevents an accidental or undesired access. When deliberate access is to be gained to the sliver intake assembly, for example, for the purpose of replacing the coiler cans 1*a*, 1*b* and/or 1*c*, the hood elements 8*a* and 8*b* are pivoted upwardly into their open position as shown, for example, in FIG. 8*b* and in phantom lines in FIG. 5. It is noted that in the construction according to FIG. 5 additional end panels 8*c*, 8*d*, 8*e* and 8*f* are provided for closing the inner space of the hood from the front and the rear as well, whereby the hood defines an inner space from four vertical sides.

Figure 3:
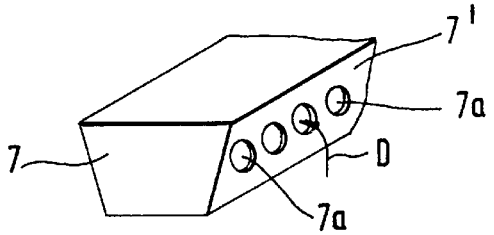
FIG. 3 is a perspective view of a detail of the structure shown in FIG. 1*a*.

As shown in FIGS. 3 and 7, the suction duct 7 has a cross-sectionally trapezoidal shape. It has side walls 7' which are provided, along their length, with a plurality of apertures 7*a* through which air is drawn from the outside in the direction D to generate a suctional air flow to which the roll pairs 4*a*, 5*a*; 4*b*, 5*b*; and 4*c*, 5*c* are exposed. As a result, waste material, such as dust or fiber fly freed from the sliver as it is compressed by the roll pairs is entrained by the vacuum stream into the duct 7. In this manner, the guide elements 9*a* shown in FIG. 4, the roll pairs 4*a*, 5*a*, 4*b*, 5*b*, and 4*c*, 5*c* and the slivers 3*a*, 3*b* and 3*c* are cleaned. The slivers 3*a*, 3*b* and 3*c* drawn from the respective coiler cans 1*a*, 1*b* and 1*c* balloon particularly in case of high sliver-advancing speeds. By virtue of such a motion of the slivers, a substantial amount of dust and fiber fly is released which, particularly at the inlet location of the guide elements 9*a* where a quieting of the stream is effected, is separated and drawn away by the air stream.

Figure 2:
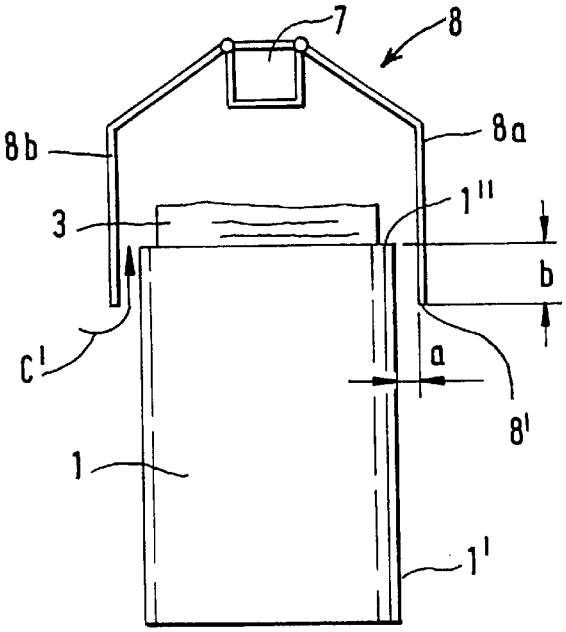
FIG. 2 is an end elevational view of a variant of the construction shown in FIG. 1*a*.

Turning to FIG. 2, the lower edge 8' of the closed hood assembly 8 is at a small distance a from the cylindrical face 1' of a coiler can 1. In this manner, the air stream C' drawn in from the outside by the flow in the suction duct 7 is reinforced. Further, the lower edge 8' of the hood assembly 8 is at a vertical distance b underneath the upper edge 1" of the coiler can 1. The lower edge 8' may be positioned as high as the level of the upper edge 1".

In FIG. 5, underneath the intake table 2, two rows of coiler cans 1*a*', 1*b*', 1*c*' and 1*a*", 1*b*", 1*c*" are shown. The suction duct 7 extends above the intake table 2 which supports the hood element 8*a* covering one row of the cans and the hood element 8*b* covering the other, adjacent row. The hood elements 8*a* and 8*b* are secured to the suction duct 7 by hinges and are pivotal in the direction of arrows F and G into open and closed positions. FIG. 5 illustrates the hood elements 8*a*, 8*b* in phantom lines in their upward, open position. When pivoted downwardly, the hood parts 8*a* and 8*b* assume a position as illustrated in FIG. 2.

In FIG. 6 the hood is formed by two roller shade-type devices 10*a* and 10*b* which may be pulled down into a closed, operative position or rolled up into a withdrawn, inoperative position.

In FIG. 7 the hood parts 8*a* and 8*b* are shown in their closed position in which they slope downwardly from the suction duct 7 at an angle a to the horizontal whereby the air streams E' and E" are guided towards the openings 7*a* of the suction duct 7. Terminal portions of the hood parts 8*a*, 8*b* are angled, so that in the closed position such terminal portions assume a vertically downward orientation.

Figure 8A:
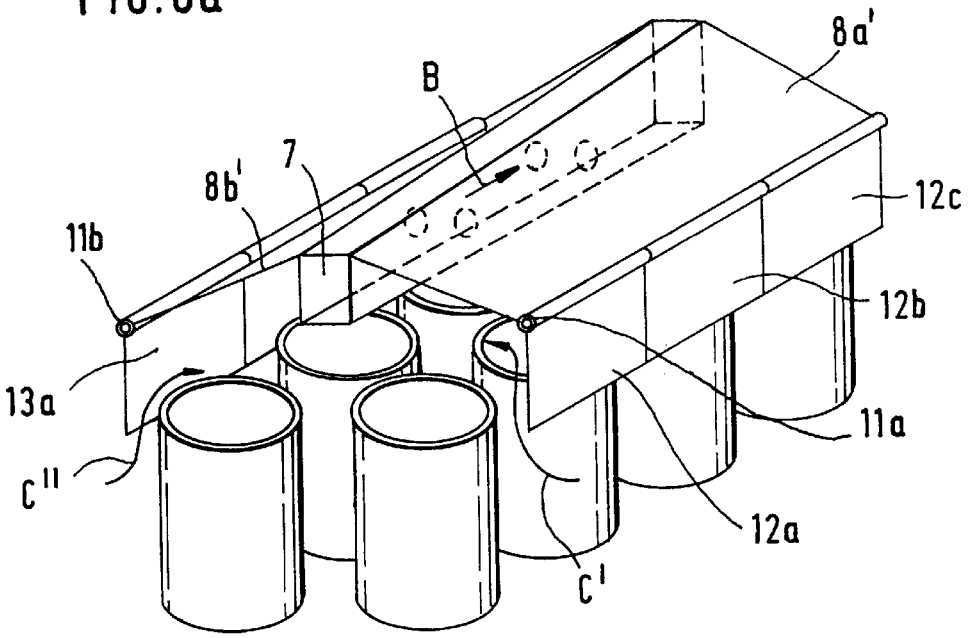
FIG. 8*a* is a perspective view of yet another preferred embodiment of the invention shown in a laterally closed position.
Figure 8B:
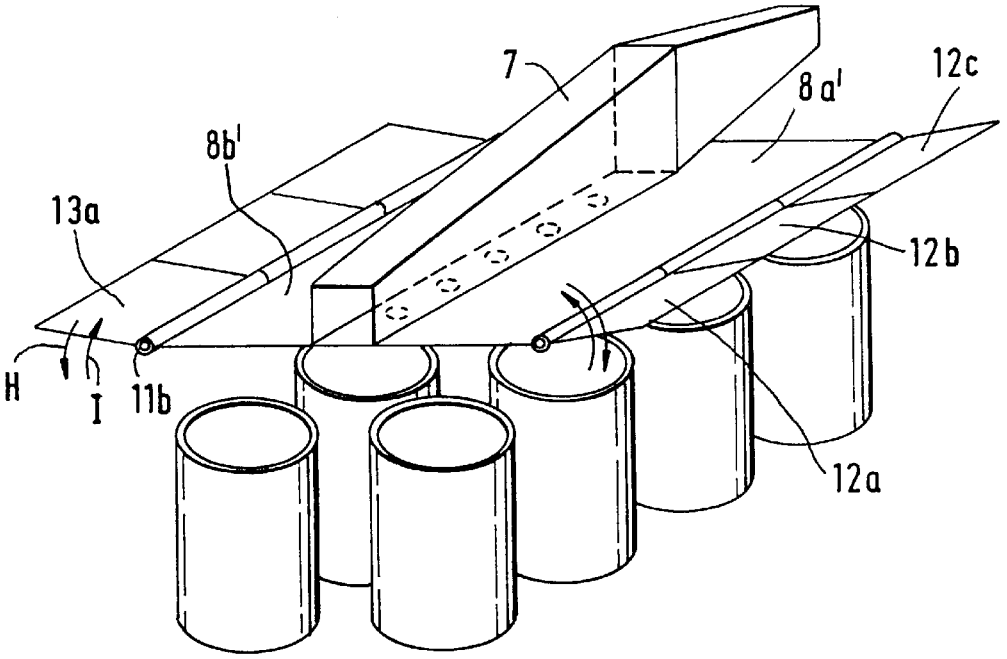
FIG. 8*b* is an illustration similar to FIG. 8*a*, showing the structure in an open lateral position.

Turning to FIGS. 8*a* and 8*b*, the cross section of the suction duct 7 increases as viewed in the direction of the air flow B. The hood is formed of two hood elements 8*a*' and 8*b*' which are secured to the duct 7 and may be affixed thereto in a downwardly sloping orientation (FIG. 8*a*) or in a substantially horizontal alignment (FIG. 8*b*). Or, in the alternative, the hood elements 8*a*', 8*b*' may by hinged to the duct 7. The outer lower edges of the hood elements 8*a*', 8*b*' are provided with hinges 11*a* and 11*b*, respectively, for carrying terminal flaps 12 (for the hood element 8*a*) and 13 (for the hood element 8*b*). The terminal flaps 12 and 13 are pivotal in a vertical plane in the direction of the arrows H and I. FIG. 8*a* shows the construction in a closed, operating position whereas in FIG. 8*b* the terminal flaps 12 and 13 assume a raised, generally horizontal, coplanar position in which the hood assembly is open, for example, for the purpose of effecting coiler can replacement.

Figure 9:
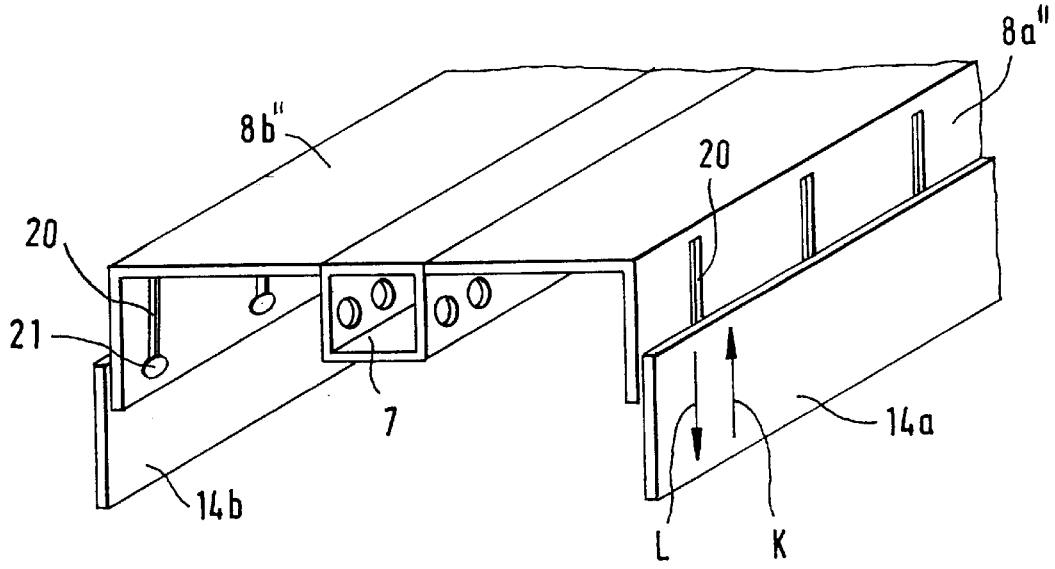
FIG. 9 is a perspective view of still another preferred embodiment of the invention.

In FIG. 9, the hood elements 8*a*" and 8*b*" of the hood are angled elements with rectangularly bent, approximately vertically oriented wall portions to which vertically slidable terminal flaps 14*a*, 14*b* are secured which are movable in the direction of the arrows K and L. For such securing purposes the hood elements 8*a*" and *b*" are provided with vertical slots 20 into which extend lugs 21 affixed to the respective terminal flaps 14*a*, 14*b*. The slots 20 may also serve as inlet openings through which an air stream enters into the inner space defined by the hood.

Figure 10:
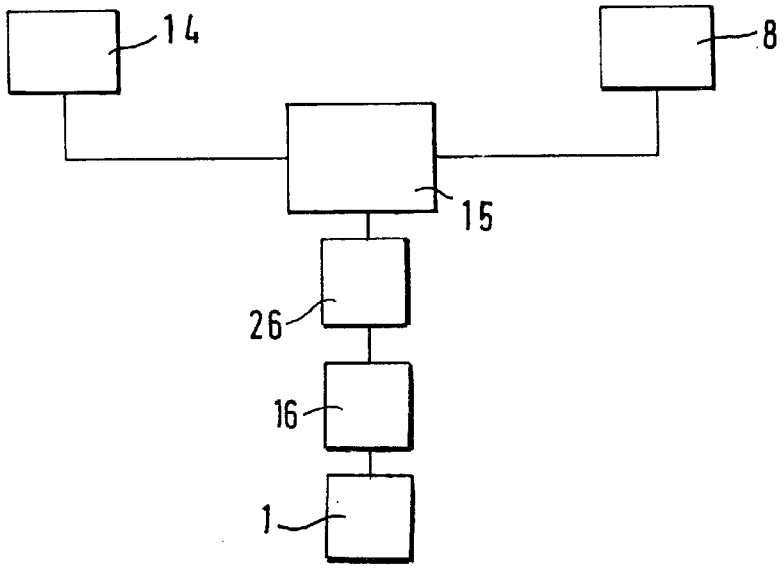
FIG. 10 is a block diagram for the control of the structure according to the invention.

Turning to FIG. 10, the hood structures shown in various embodiments may be mechanically controlled, for example, by driving devices 15 such as a pneumatic pressure cylinder, electric motors or the like. Further, an electronic control and regulating device 26, for example, a microcomputer, is provided, together with a fill level sensing arrangement 16, all connected to the control and regulating device 26 to automatically place the hood assembly into its withdrawn, inoperative position when the sensor device 16 emits a signal indicating, for example, a nearly empty condition of at least one of the coiler cans.

It will be understood that the above description of the present invention is susceptible to various modifications, changes and adaptations, and the same are intended to be comprehended within the meaning and range of equivalents of the appended claims.

What is claimed is:

1. A combination of a sliver intake assembly for guiding and introducing simultaneously a plurality of slivers into a drawing frame and a suction assembly for removing waste; said slivers having a direction of advance through said sliver intake assembly; said sliver intake assembly comprising a plurality of rolls spaced in said direction of advance for guiding said slivers; said combination comprising (a) an emplacement situated below said sliver intake assembly for accommodating a plurality of coiler cans from which slivers are withdrawn by said sliver intake assembly;

(b) a suction duct forming part of said suction assembly and extending along said sliver intake assembly in a region thereof for drawing waste thereinto by vacuum; and (c) a common air guide extending along said sliver intake assembly over said plurality of rolls; said common air guide forming part of said suction assembly and being coupled to said suction duct for guiding air into said suction duct.

2. A combination of a sliver intake assembly for guiding and introducing simultaneously a plurality of slivers into a drawing frame and a suction assembly for removing waste; said combination comprising (a) an emplacement situated below said sliver intake assembly for accommodating a plurality of coiler cans from which slivers are withdrawn by said sliver intake assembly;

(b) a suction duct forming part of said suction assembly and extending above and along said sliver intake assembly; said suction duct having air intake apertures along said sliver intake assembly for providing passage of air into said suction duct;

(c) a hood forming part of said suction assembly and extending along and over said sliver intake assembly; said hood having an operative position in which said hood defines a downwardly open space; said air intake apertures being situated in said space; and (d) means for coupling said suction duct to a vacuum source for generating an air current in said suction duct in a flow direction.

3. The combination as defined in claim 2, wherein said sliver intake assembly is situated at least partially in said space.

4. The combination as defined in claim 2, wherein parts of said hood slope towards said duct for directing the air stream towards said apertures in said duct.

5. The combination as defined in claim 2, wherein said hood surrounds said sliver intake assembly on four vertical sides.

6. The combination as defined in claim 2, wherein an inner cross-sectional area of said duct widens as viewed in said flow direction.

7. The combination as defined in claim 2, further comprising means for movably supporting at least a portion of said hood to allow displacement of the hood portion into a withdrawn, inoperative position.

8. The combination as defined in claim 7, further comprising (a) sensor means for emitting a signal when a predetermined degree of sliver fill in at least one of the coiler cans situated on said emplacement is reached;

(b) driving means for moving said at least one portion of said hood into the operative or inoperative position; and (c) control and regulating means connected to said driving means and said sensor means for automatically placing said at least one hood portion into said inoperative position when said degree of sliver fill is reached.

9. The combination as defined in claim 2, wherein said hood includes two hood parts extending laterally from opposite sides of said duct.

10. The combination as defined in claim 9, wherein said hood parts are fixedly supported at said duct.

11. The combination as defined in claim 9, further comprising hinges pivotally supporting said hood parts at said duct.

12. The combination as defined in claim 2, wherein said hood includes a first hood part extending above and bilaterally of said duct and second hood parts movably secured to said first hood part.

13. The combination as defined in claim 12, further comprising hinges pivotally securing said second hood parts to said first hood part.

14. The combination as defined in claim 12, further comprising securing means for slidably mounting said second hood parts on said first hood part.

15. The combination as defined in claim 14, wherein said securing means comprises slots provided in said first hood part and lugs affixed to said second hood parts; said lugs extending into respective said slots for sliding displacements therein.

16. A combination of a sliver intake assembly for guiding and introducing simultaneously a plurality of slivers into a drawing frame and a suction assembly for removing waste; said combination comprising (a) an emplacement situated below said sliver intake assembly;

(b) a plurality of coiler cans from which slivers are withdrawn by said sliver intake assembly; said coiler cans standing on said emplacement;

(c) a suction duct forming part of said suction assembly and extending above and along said sliver intake assembly; said suction duct having air intake apertures along said sliver intake assembly for providing passage of air into said suction duct;

(d) a hood forming part of said suction assembly and extending along and over said sliver intake assembly; said hood having an operative position in which said hood defines a downwardly open space; said air intake apertures being situated in said space; said hood having lowermost bounding edges being, in said operative position, at a level at the most as high as a height level of uppermost boundary edges of said coiler cans; and (e) means for coupling said suction duct to a vacuum source for generating an air current in said suction duct in a flow direction.

17. The combination as defined in claim 16, wherein said lowermost bounding edges of said hood and said coiler cans together define an inlet aperture for allowing air to be drawn from below into said inner space of said hood.

18. The combination as defined in claim 16, wherein said lowermost bounding edges of said hood are situated, in said operative position, at a level lower than the height level of said uppermost boundary edges of said coiler cans.

* * * * *